United States Patent [19]
Oonishi
[11] 4,227,379
[45] Oct. 14, 1980

[54] COOLING APPARATUS

[75] Inventor: Toshiyuki Oonishi, Takatsuki, Japan

[73] Assignee: Tokyo Shibaura Denki Kabushiki Kaisha, Kawasaki, Japan

[21] Appl. No.: 14,228

[22] Filed: Feb. 23, 1979

[30] Foreign Application Priority Data

Feb. 23, 1978 [JP] Japan ..... 53/20197
Feb. 28, 1978 [JP] Japan ..... 53/24820[U]

[51] Int. Cl.[3] ..... F25B 41/00
[52] U.S. Cl. ..... 62/198; 62/199; 62/524
[58] Field of Search ..... 62/197, 198, 199, 524

[56] References Cited

U.S. PATENT DOCUMENTS

| | | | |
|---|---|---|---|
| 2,539,908 | 1/1951 | Jenkins | 62/198 |
| 2,706,894 | 4/1955 | Shoemaker | 62/198 |
| 2,719,407 | 10/1955 | Zearfoss, Jr. | 62/198 |
| 2,723,533 | 11/1955 | Mann | 62/198 |
| 3,950,961 | 4/1972 | Lotz | 62/198 |

*Primary Examiner*—Ronald C. Capossela
*Attorney, Agent, or Firm*—Oblon, Fisher, Spivak, McClelland & Maier

[57] ABSTRACT

A cooler for a freezing chamber of a cooling apparatus having a low temperature portion cooling region and a very low temperature portion cooling region. The frost is concentrated on the very low temperature portion, and there is no frost adhesion to the low temperature portion.

10 Claims, 5 Drawing Figures

COOLING APPARATUS

BACKGROUND OF THE INVENTION

1. Field of the Invention

This invention relates to a cooling apparatus wherein part of the cooler for the freezing chamber is provided with a very low temperature portion.

2. Description of the Prior Art

In a freezing refrigerator of the so-called direct cooling type, wherein the freezing chamber cooler is formed approximately as a rectangular box and the interior thereof is utilized as the freezing chamber, the freezing chamber is practically uniformly cooled in approximately the whole region of the inside face of the cooler of the freezing chamber. However, in this type of refrigerator, during the cooling operation, frost adheres to practically the entire region of the inside surface of the freezing chamber cooler. Since this frost has a thermally insulating effect, this results in the drawback that the cooling effect is diminished. Furthermore, there is the inconvenience that frost adheres even to articles which are accommodated therein, such as the ice tray etc.

SUMMARY OF THE INVENTION

Accordingly, an object of this invention is to provide a freezing cooling apparatus wherein the cooler for the freezing chamber is constructed of a low temperature portion cooler and a very low temperature portion cooler, which is of lower temperature than the first-mentioned cooler, so that the region of frost adhesion of the cooler of the freezing chamber can be reduced and the cooling efficiency thereby raised, while articles which are accommodated therein, such as ice trays etc. can be prevented from being subjected to frost adhesion.

Another object of this invention is to provide a freezing and cooling apparatus characterised in that, in the freezing chamber, there are provided a low temperature portion cooling region and a very low temperature portion cooling region, the latter of which is of lower temperature than the former region.

A further object of this invention is to provide a freezing and cooling apparatus characterised in that the cooler which provides the low temperature portion cooling region and the cooler which provides the very low temperature portion cooling region are constructed by a single cooling cycle or means.

BRIEF DESCRIPTION OF THE DRAWINGS

Various other objects, features and attendant advantages of the present invention will be more fully appreciated as the same becomes better understood by the following detailed description when considered in connection with the accompanying drawings wherein like reference characters designate like or corresponding parts throughout the several views, and wherein.

DETAILED DESCRIPTION OF THE PREFERRED EMBODIMENTS

Figure 1:
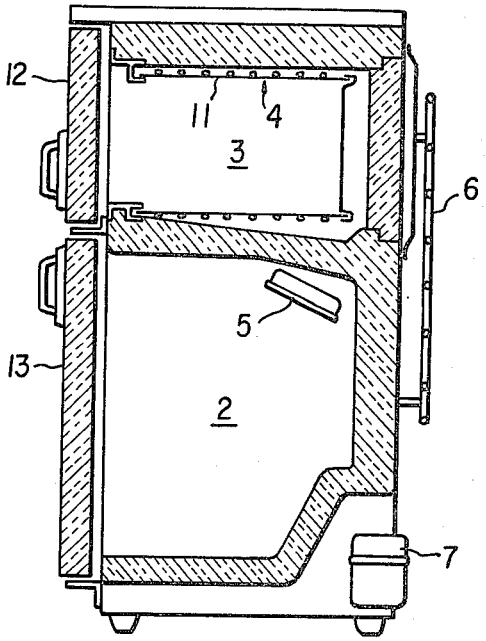
FIG. 1 is a longitudinal sectional view.
Figure 2:
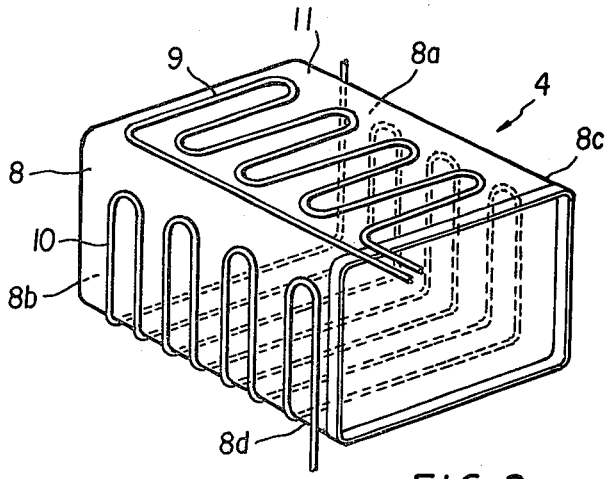
FIG. 2 is a perspective view on a larger scale seen from the rear of the freezing chamber cooler.

An embodiment of this invention is explained below with reference to the drawings. FIG. 1 shows a freezing refrigerator, in which 1 is the main body of the refrigerator, in the interior of which a cold chamber 2 is formed, while, in the upper region of this cold chamber 2, there is arranged a freezing chamber cooler 4 whose interior provides a freezing chamber 3. 5 is a cooler for the cold chamber and is arranged in the upper region of the cold chamber 2. 6 and 7 are respectively a condenser and compressor which are arranged at the back and at the lower region of the back of the refrigerator 1. The cooler 4 for the freezing chamber, as shown from the rear in FIG. 2, is constructed by joining, in a thermally conductive manner, for example by welding, two long evaporation pipes 9 and 10 to the outside of the body 8 of the cooler, which is constructed of aluminium plate and has the form of a rectangular box of which the front face is open. Part of the cooler body 8, for example, the upper part 8*a*, forms the cooler 11 which provides the very low temperature portion region. One evaporation pipe 9 is laid on this cooler 11, while another evaporation pipe 10 is laid on the left and right side parts 8*b*, 8*c*, and the bottom part 8*d* of the cooler body 8. As will become clear from the following description, the cooler 11 is constructed to reach a low temperature, for example, at least 5° lower, than the cooler which provides the low temperature portion region and which consists of the other portions of the cooler body 8, namely, the left and right side parts 8*b*, 8*c* and the bottom part 8*d*. 12 is the door of the freezing chamber, and 13 is the door of the cold chamber.

Figure 3:
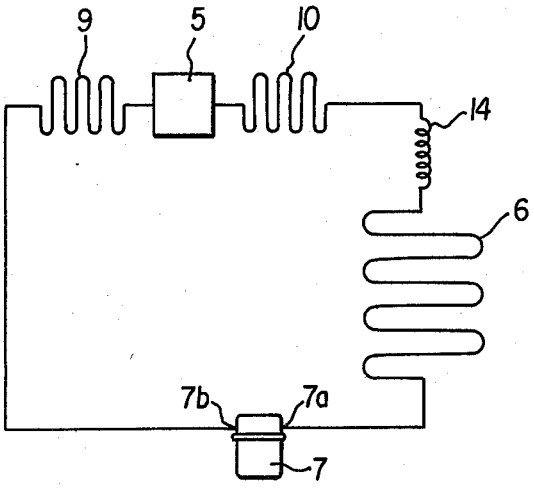
FIG. 3 is a diagram of the cooling cycle.

The cooling cycle will now be explained with reference to FIG. 3. In this cycle, between the intake 7*b* and discharge opening 7*a* of a compressor 7, a condenser 6, capillary tube 14, said other evaporation pipe 10 which acts as the cooler for the very low temperature portion cooling region of the cooler 4 for the freezing chamber, the cooler 5 for the cold chamber, and the evaporation pipe 9 which acts as the cooler for the low temperature portion region of the freezing chamber cooler 4 are connected in sequence.

The operation of this construction will now be explained. When the compressor 7 is operating, liquid coolant, which has passed through the condenser 6 and capillary tube 14, flows in sequence into the said other evaporation pipe 10, cold chamber cooler 5, and evaporation pipe 9, in which it is respectively evaporated, thereby cooling the cold chamber 2 and the freezing chamber 3. However, the evaporation temperature of the liquid coolant in said other evaporation pipe 10, cold chamber cooler 5, and evaporation pipe 9 falls between said other evaporation pipe 10, cold chamber cooler 5, and evaporation pipe 9. The reason for this is that, as the pressure of the liquid coolant drops, evaporation occurs at a lower temperature and, as the inlet aperture 7*b* of the compressor 7 is approached, the pressure drops due to the suction effect of the compressor 7. Thus the cooler is of the very low temperature region which is provided by the evaporation pipe 9 reaches a temperature which is for example at least 5° C. lower than that of the cooler which consists of the left and right side parts 8*b*, 8*c* and the bottom part 8*d* i.e. the other portions of the cooler body 8, on which said other evaporation pipe 10 is arranged.

In general, frost is formed and adheres to a cooler when the temperature of the cooler drops below 0° C. However, since, in this cooler, there exists a very low temperature portion region, which is of lower temperature than the other parts thereof, the frost which adheres to the said other parts of the said cooler, which are at a comparatively higher temperature, sublimes and collects in the very low temperature portion region. This phenomenon is particularly marked when the very low temperature portion is at least 5° C. lower than the other parts.

Thus, when frost adheres to the inside wall of the freezing chamber 3 i.e. to the inside face of the freezing chamber cooler 4, since, in the freezing chamber cooler 4, there is present a very low temperature portion cooler 11, which is at a temperature at least 5° C. lower than the other parts thereof, the frost which adheres to the cooler of the left and right side parts 8*b*, 8*c* and the bottom part 8*d* of the cooler body 8 gradually sublimes, turning into vapour, which again turns into frost on the cooler 11 of the very low temperature portion, to which it adheres. Thus the frost is concentrated on the very low temperature portion 11, and there is no frost adhesion to the other parts.

Accordingly, in this embodiment, frost adhesion is concentrated on the very low temperature portion cooler 11, so that adhesion of frost to the low temperature portion cooler, consisting of the left and right side parts 8*b*, 8*c* and the bottom part 8*d* of the cooler body 8 is prevented. Therefore, in contrast to the previously employed refrigerator, in which frost adhered approximately to the entire region of the inside surface of the freezing chamber cooler, the cooling efficiency of the freezing chamber cooler 4 is greatly increased in comparison with the said previously used refrigerator. Furthermore, even if frost should adhere to articles which are accommodated therein, such as an ice tray received in the freezing chamber 3, immediately after its insertion, due to the aforementioned sublimation effect, the frost on this accommodated article is liberated from the accommodated article and moves to the very low temperature region cooler 11. Frost adhesion to the accommodated article can thereby be permanently prevented in a reliable fashion.

In particular, in this embodiment, since the very low temperature portion cooler 11 is provided in the upper part 8*a* of the cooler body 8, the frost is effectively concentrated on the very low temperature portion cooler 11. The reason for this is that, when external atmosphere enters the freezing chamber 3 due to opening of the freezing chamber door 12, the comparatively warm moisture which enters with this external atmosphere drifts to the upper part of the freezing chamber 3 i.e. to the region of the very low temperature portion cooler 11. Consequently, this moisture immediately adheres as frost to the very low temperature portion 11, before it can adhere to the cooler for the low temperature portion, consisting of the left and right side parts 8*b*, 8*c* and bottom part 8*d* of the cooler body 8.

The very low temperature portion 11 need not be provided at the upper part 8*a* of the cooler body 8, but the desired object can still be achieved so long as it is provided in a part of the freezing chamber cooler 4.

Next, referring to FIG. 4, a cooling cycle adopted in another embodiment of this invention will be described. Between the inlet 7*b* and the discharge opening 7*a* of the compressor 7, in sequence from the discharge opening 7*a*, there are connected a condenser 6, a main capillary tube 14, an electromagnetic valve (flow path control means) 15, an ancillary capillary tube 16, an evaporation pipe 10 for the low temperature portion regions of the freezing chamber cooler 4, a cold chamber cooler 5, and an evaporation pipe 9 for the very low temperature portion region of the freezing chamber cooler 4; these being connected in series. Thus, the evaporation pipe 11 for the very low temperature portion is positioned on the side of the inlet 7*b* of the compressor 7 of the series circuit which consists of the cold chamber cooler 5 and the low temperature portion region evaporation pipe 10. 17 is a side-path capillary tube, one end of which is connected to the inlet of the electromagnetic valve 15, while its other end is connected to the discharge opening of the cold chamber cooler 5. Thus, the side path 18 is arranged in parallel with the series circuit consisting of the evaporation pipe 10 and the cooling chamber cooler 5. The said electromagnetic valve 15 is opened, by a temperature-controlled device (not shown), when the temperature inside the cold chamber 2 rises above the set temperature, and closed when this temperature falls below the set temperature.

When the compressor 7 is operated, gaseous coolant at high temperature and high pressure, which has been compressed by the compressor 7, is supplied to the condenser 6, where it is converted to liquid coolant at low temperature and high pressure. This passes through the main capillary tube 14, where its pressure is reduced. Then when the electromagnetic valve 15 is opened, and when the temperature inside the cold chamber 2 is above the set temperature, it passes through the electromagnetic valve 15 and the ancillary capillary tube 16, whence it is supplied to the other evaporation pipe 10, cold chamber cooler 5 and evaporation pipe 9 respectively, and evaporated, thus turning into gaseous coolant at low temperature and low pressure, which is returned to the compressor 7. In this way, the cold chamber 2 and freezing chamber 3 are cooled. However, the evaporation temperature of the liquid coolant in the evaporation pipe 9 is lower than that in the other evaporation pipe 10. The reason for this is that, the lower the pressure of the liquid coolant, the lower the temperature at which it evaporates, and, as the inlet 7*b* of the compressor 7 is approached, the pressure is reduced by the suction effect of the compressor 7, while, in particular, the other evaporation pipe 10 and the cold chamber cooler 5 positioned on the inlet side thereof experience a pressure reduction effect with respect to the evaporation pipe 9. Consequently, the very low temperature portion 9 which is provided with the evaporation pipe 9 is at a temperature, for example, at least 5° C. lower than the temperature of the low temperature portion 8 which is provided with the other evaporation pipe 10. That is, as explained with reference to FIG. 3 above, the frost concentrates on the very low temperature portion, this phenomenon being particularly marked when the temperature difference is 5° C. or more.

When frost adheres to the inside wall of the freezing chamber 3 i.e. the inside surface of the freezing chamber cooler 4, since there is present a very low temperature portion cooler 11, which is at a temperature at least 5° C. lower than the other parts of the freezing chamber cooler 4, frost which has adhered to the low temperature portion cooler of the cooler body 8 gradually sublimes, turning into vapour, which again adheres as frost to the cooler 11 for the very low temperature portion. Frost therefore concentrates on the cooler 11 for the very low temperature portion, and the other parts are not subjected to frost adhesion.

When the interior of the cold chamber 2 is overcooled, i.e. when the temperature in the cold chamber 2 falls below the set temperature, the electromagnetic valve 15 is closed. Liquid coolant which has passed through the main capillary tube 14 is therefore supplied through the side-path 18 to the evaporation pipe 9, bypassing the other evaporation pipe 10 and the cold chamber cooler 5. Thus, overcooling of the freezing chamber 2 is prevented, so that it is always maintained at the set temperature. The very low temperature portion cooler 11 is thus cooled irrespective of the load on the cold chamber cooler 5 and the low temperature portion cooler, so that the frost concentration effect described above is permanently carried out.

Thus, as explained above, in this embodiment, the freezing chamber cooler 4 is divided into a cooler for the very low temperature portion region and a cooler for the low temperature portion region, and, in the series circuit consisting of the other evaporation pipe 10 i.e. the low temperature portion region cooler and the cold chamber cooler 5, the connection of the evaporation pipe 9 i.e. very low temperature portion region cooler is such that it is positioned on the side of the inlet *7b* of the compressor 7. Consequently, the very low temperature portion region cooler assumes a lower temperature than the low temperature portion region cooler. The result of this is that adhesion of frost to the low temperature portion region cooler is prevented, thus considerably raising the efficiency of cooling. Furthermore, even if frost should adhere to accommodated articles, such as ice trays, received in the cold chamber 3, immediately after their insertion, due to the sublimation effect described above, the frost on the accommodated articles is liberated therefrom and transferred to the low temperature portion region cooler, so that frost adhesion to the accommodated articles is permanently and reliably prevented. Furthermore, since there is provided an electromagnetic valve 15 which controls flow of liquid coolant to the said series circuit, while there is also provided a bypass 18 for the said series circuit, the very low temperature portion region cooler can be cooled independently of the load on the cold chamber cooler 5 and the low temperature portion region cooler.

Figure 5:
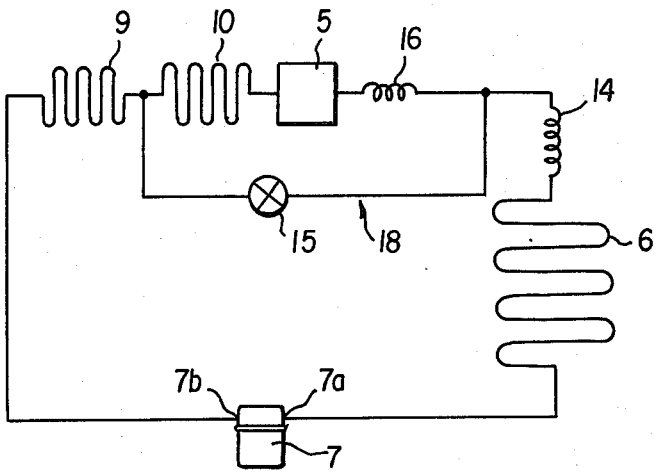
FIG. 5 is a diagram of the cooling cycle, explaining yet another embodiment of this invention.
Figure 4:
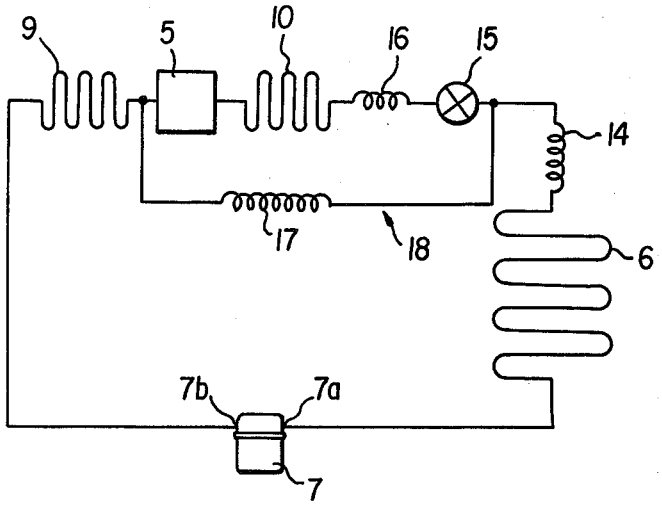
FIG. 4 is a diagram of the cooling cycle, explaining another embodiment.

The positions of connection of the electromagnetic valve 15 and the relationship of connection of the cold chamber cooler 5 and the low temperature portion region cooler (other evaporation pipe 10) may also be as shown in FIG. 5, where the same parts are given the same reference numerals as in FIG. 4. Specifically, in FIG. 5, the relationship of connection of the low temperature portion region cooler (other evaporation pipe 10) and cold chamber cooler 5 is reversed, and the electromagnetic valve 15 is provided in the bypass 18. In this case, the electromagnetic valve 15 is closed when the temperature in the cold chamber 2 rises above the set temperature. Further, instead of using an electromagnetic valve 15 as a flow control means, flow control can be carried out by means of the heat from a heater which is provided to heat the ancillary capillary tube 16 to a suitable extent.

The invention is not limited to the embodiments described and shown in the drawings, but may be altered in various ways without departing from its essence.

As explained above, this invention provides a refrigerator wherein the region of frost adhesion to the cooler of the freezing chamber is reduced, thus increasing the cooling efficiency, and also preventing adhesion of frost to accommodated articles such as ice trays, and wherein the very low temperature portion region coller can be cooled independently of the load on the low temperature portion region cooler and cold chamber cooler.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A cooling apparatus comprising:

a freezing chamber;

a cold chamber;

a compressor having an intake, a condenser, and a capillary tube, all connected in series a first coolant pipe for said freezing chamber, said first coolant pipe being connected in series with said compressor, condenser and capillary tube, said first coolant pipe forming a low temperature portion cooling region for said freezing chamber;

a second coolant pipe for said freezing chamber, said second coolant pipe being connected in series with said first coolant pipe and being connected adjacent said compressor intake side thereof, said second coolant pipe forming a very low temperature portion cooling region for said freezing chamber; and a third coolant pipe for said cold chamber, said third coolant pipe being connected between, and in series with, said first and second coolant pipes, whereby said very low temperature portion is cooled to a lower temperature by said second coolant pipe than said low temperature region is cooled by said first coolant pipe.

2. The cooling apparatus of claim 1 wherein said low temperature portion cooling region is comprised by a wall of said freezing chamber.

3. The cooling apparatus of claim 2 wherein said second coolant pipe is located in a portion of said freezing chamber wall.

4. The cooling apparatus of claim 3 wherein said very low temperature portion cooling region is located in the upper part of said freezing chamber wall.

5. The cooling apparatus of claim 3 wherein the temperature difference between the temperature of the surface of said second coolant pipe and the temperature of said low temperature portion cooling region is at least 5° C.

6. The cooling apparatus of claim 1 wherein the temperature difference between the surface of said second coolant pipe and the temperature of the surface of said first coolant pipe is at least 5° C.

7. The cooling apparatus of claim 1 wherein a parallel bypass is provided for said first coolant pipe and said third coolant pipe.

8. The cooling apparatus of claim 7 wherein said first coolant pipe has an inlet and wherein an electromagnetic valve is connected adjacent said inlet side of said first coolant pipe, said electromagnetic valve being adapted to regulate the flow of coolant.

9. The cooling apparatus of claim 8 including a capillary tube connected between said electromagnetic valve and said first coolant pipe.

10. A cooling apparatus comprising:

a freezing chamber;

a cold chamber;

a compressor having an intake, a condenser, and a capillary tube, all connected in series a first coolant pipe for said freezing chamber, said first coolant pipe being connected in series with said compressor, condenser and capillary tube, said first coolant pipe forming a low temperature portion cooling region for said freezing chamber a second coolant pipe for said freezing chamber, said second coolant pipe being connected in series with said first coolant pipe and being connected adjacent said compressor intake side thereof, said second coolant pipe forming a very low temperature portion cooling region for said freezing chamber;

a third coolant pipe for said cold chamber, said third coolant pipe being connected in series with first and second coolant pipes; and a parallel by pass in said series for said first and third coolant pipes, whereby coolant may by pass said first and third coolant pipes but not said second coolant pipe.

* * * * *